US005723945A

United States Patent [19]

Schermerhorn

[11] Patent Number: 5,723,945

[45] Date of Patent: Mar. 3, 1998

[54] FLAT-PANEL DISPLAY

[75] Inventor: Jerry D. Schermerhorn, Perrysburg, Ohio

[73] Assignee: Electro Plasma, Inc., Millbury, Ohio

[21] Appl. No.: 629,723

[22] Filed: Apr. 9, 1996

[51] Int. Cl.[6] ..... H01J 17/49

[52] U.S. Cl. ..... 313/581; 313/584; 313/586; 313/292; 313/610; 313/612

[58] Field of Search ..... 313/585, 584, 313/583, 586, 581, 245, 250, 257, 258, 262, 268, 288, 289, 292, 610, 611, 612, 113

[56] References Cited

U.S. PATENT DOCUMENTS

| | | | |
|---|---|---|---|
| 3,755,027 | 8/1973 | Gilsing | 313/584 X |
| 3,942,061 | 3/1976 | Van Esdonk et al. | 313/584 |
| 4,269,918 | 5/1981 | Nonogaki et al. | 430/28 |
| 4,318,970 | 3/1982 | Kurland et al. | 430/2 |
| 4,559,294 | 12/1985 | Navarrete | 430/306 |
| 4,723,093 | 2/1988 | Nolan | 313/643 |
| 4,965,153 | 10/1990 | Imataki et al. | 430/11 |
| 4,990,415 | 2/1991 | Yu | 430/2 |
| 5,110,707 | 5/1992 | Fujita et al. | 430/256 |
| 5,116,271 | 5/1992 | Arimoto | 445/24 |
| 5,144,200 | 9/1992 | Kim | 313/585 X |
| 5,164,633 | 11/1992 | Kim et al. | 313/584 X |
| 5,189,952 | 3/1993 | Ohmura et al. | 101/211 |
| 5,209,688 | 5/1993 | Nishigaki et al. | 445/24 |
| 5,446,344 | 8/1995 | Kanazawa | 315/169 |
| 5,525,862 | 6/1996 | Miyazaki | 313/584 X |
| 5,541,479 | 7/1996 | Nagakubo | 313/584 X |

OTHER PUBLICATIONS

Glass–Ceramics and Photo–Sitalls, A. Berezhnoi, pp. 9–20, De. 1970.

Fujitsu shows color plasma display panel, Junko Yoshida, Electronic Engineering Times, Monday, Oct. 12, 1992, Issue 714.

*Primary Examiner*—Ashok Patel

*Attorney, Agent, or Firm*—Brinks Hofer Gilson & Lione

[57] ABSTRACT

A flat-panel display comprising a hermetically sealed gas filled enclosure. The enclosure includes a top glass substrate having a plurality of electrodes and a thin dielectric film covering the electrodes and a bottom glass substrate spaced from the top glass substrate. The bottom glass substrate includes a plurality of alternating barrier ribs and micro-grooves. An electrode is deposited over each micro-groove and a phosphor is deposited over a portion of each electrode coating.

25 Claims, 5 Drawing Sheets

FIG. 1
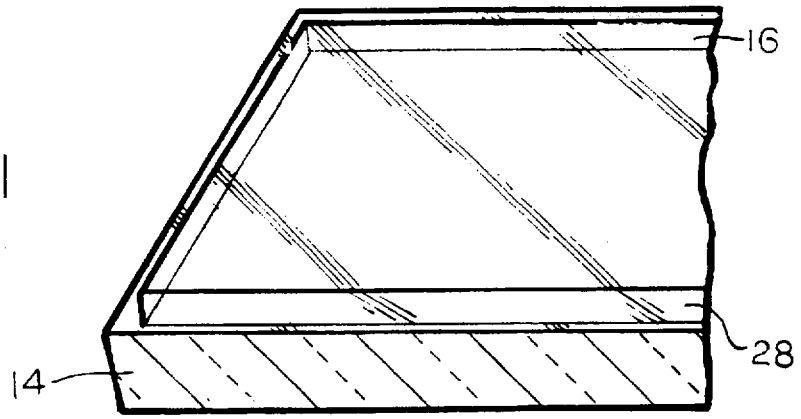
FIG. 2
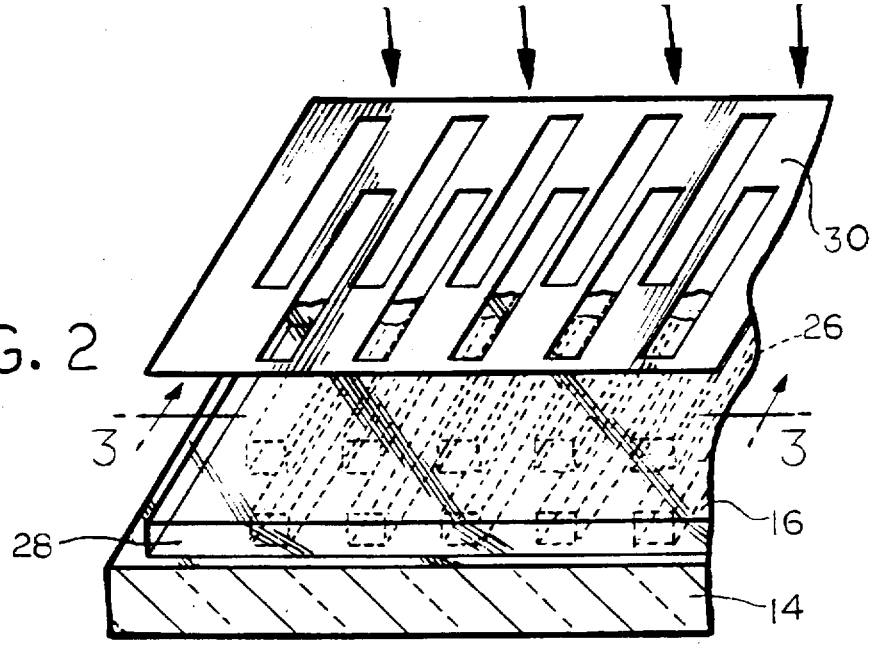
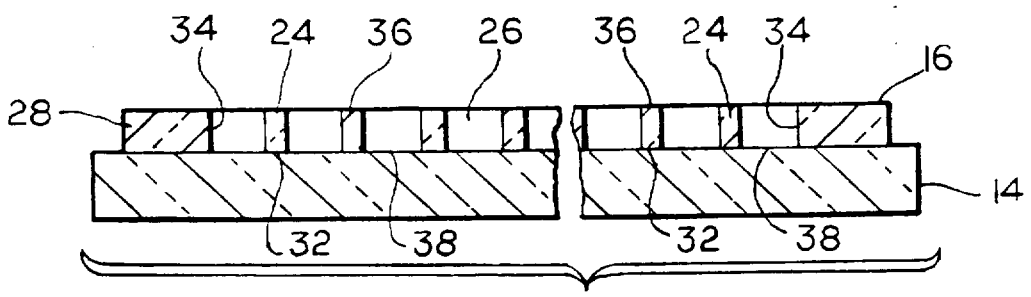
FIG. 3

FLAT-PANEL DISPLAY

FIELD OF THE INVENTION

This invention relates to a flat-panel display and method of manufacture. More particularly, this invention relates to a full color, high resolution capable flat-panel display having high aspect ratio barrier ribs and a method of manufacture.

BACKGROUND OF THE INVENTION

A flat-panel display is an electronic display composed of a large array of display picture elements, called pixels, arranged in a two-dimensional matrix. Examples of a flat-panel display are electroluminescent devices, AC plasma panels, DC plasma panels and field emission displays and the like.

The basic structure of a flat-panel plasma display comprises two glass plates with a conductor pattern of electrodes on the inner surfaces of each plate and separated by a gas filled gap. The conductors are configured in an x-y matrix with horizontal electrodes and vertical column electrodes deposited at right angles to each other with thin-film techniques well known in the art.

The electrodes of the AC-plasma panel display are covered with a thin glass dielectric film. The glass plates are put together to form a sandwich with the distance between the two plates fixed by spacers. The edges of the plates are sealed and the cavity between the plates is evacuated and back-filled with a neon and argon mixture.

When the gas ionizes, the dielectrics charge like small capacitors so the sum of the drive voltage and the capacitive voltage is large enough to excite the gas contained between the glass plates and produce glow discharge. As voltage is applied across the row and column electrodes, small light emitting pixels form a visual picture.

Barrier ribs are typically disposed between the foregoing insulating substrates so as to prevent cross-color and cross-pixel interference between the electrodes and increased resolution to provide a sharply defined picture. The barrier ribs provide a uniform discharge space between the glass plates by utilizing the barrier ribs height, width and pattern gap to achieve a desired pixel pitch. For example, barrier ribs of plasma display panels most desirably have a configuration of about 100μ in height and are as narrow as possible, preferably less than 20μ in width and spaced at about 120μ pitch. This requirement is necessary in order to achieve a color pixel pitch of 72 lines per inch, the printing industry standard point of type, which is equivalent to a sub-pixel pitch of 216 lines per inch with a red, green blue phosphor color arrangement. This pattern is commonly used to achieve color output in flat panel and many cathode ray tube displays with diagonal dimensions on the order of 20 to 40 inches used for displaying graphic and textual information in computer terminal equipment and television receivers.

A number of methods have been proposed and developed for making these barrier ribs including multiple screen printing of glassy material, sandblasting, squeezing method, photolithography method and a double layer method.

Barrier ribs have been most successfully formed at lower resolutions, on the order of 200μ, using a thick film printing method. This method comprises providing discharge electrodes in lines on a glass substrate, printing and firing a dielectric film, printing layers of a glass paste between adjacent electrodes on the plate by use of a printing screen and drying the paste. The printing and drying steps are repeated between about 5 to 10 times after which the plate is fired or cured at a significantly high temperature, usually in the range of 500° to 680° C. to sinter the paste into solid ribs. Attempts to achieve higher resolution have been made but are very difficult due to the large number of realignment steps over large areas and also the tendency of the paste to loose its shape during the high temperature curing cycle.

Another method of fabricating barrier ribs consists of forming an organic film of photo resist material on a pattern of discharge electrodes and filling the grooves with a glass paste. The organic material is burned out during a high temperature curing cycle. This method is restricted to lower pitch devices because of the tendency of the paste to loose its shape during the high temperature curing cycle. In addition, the removal of the photosensitive film by firing and burning causes a change in the shape and partial deformation or breakage of the barrier ribs being formed by bonding with the glass paste. Accordingly, it will be appreciated that it is difficult to form barrier ribs which have a given aspect ratio (height/base width) and that are uniform and stable.

An improvement in this method is described in U.S. Pat. No. 5,116,271 that consists of forming an organic film of photoresist material on a pattern of discharge electrodes and preheating to a temperature lower than a temperature at which the organic film undergoes an exothermic event for a given time. In the firing treatment after application of an insulating material in between and adjacent to the organic films, a change in the shape of the organic film during the process of burning off the organic film is effective in suppressing a change in shape of the barrier ribs formed by the insulating material. The insulating material consists of a glass paste comprising a glass component which softens at the pre-heating temperature and another glass component which softens in the vicinity of a curing or firing temperature of the organic film. An improvement in aspect ratio may be achieved but is still insufficient for production of high resolution plasma display panels.

There is also known a glass-ceramic material which in bulk form can produce and hold the shape of such mechanical features to an accuracy of a few microns. These materials are photosensitive glasses and were developed in the 1950's through the 1970's and commonly known as pyroceram or photoceram. The basic principal was discovered and invented by Stookey at Corning Glass Works during investigations of photosensitive glasses. Such photosensitive glasses are well known and well documented in the literature, e.g., "Glass Ceramics and Photo-Sitalls" by Anatolii Berezhnoi—Plenum Press 1970. The glass has been marketed under various names such as Fotoceram a photosensitive glass material product line. Fotoceram is a trademark of Corning Incorporated.

The most common use for use these materials in recent years is in making microscopic parts for ink jet printer orifices and the like. These materials are also common today in such products as ceramic cookware, but have not seen widespread use in micro-mechanical technologies because of their relatively high cost in comparison with alternative materials and technologies.

The composition of these photosensitive materials may be used to form various glass systems, for example, one common photosensitive glass material is composed of $Li_2O$—$Al_2O_3$—$SiO_2$. These glasses also have minority components that serve specific functions. For example, Ce and either Ag, Au, or Cu are introduced as photo-sensitizers while Na is used as a flux.

When these glasses are heated in a batch furnace at 1350°–1400° C. and rapidly cooled they exhibit a photosensitive property. Upon exposure to ultraviolet radiation (UV) in the range of about 140 to 340 nanometers (nm) Ag, for example, bonds are broken forming individual atoms. This forms a latent image in the glass which if it is heated to a temperature around 520° C. the freed atoms agglomerate. If the glass is heated still further to around 600° C. crystals, typically of Li metasilicate, Li disilicate, and Eucryptite and Spodumene phases of the base glass will form preferentially around the silver agglomerates in the exposed areas which act as a nucleating agent. The type of crystallin phase which dominates and the size of the crystals is determined by the exact time and temperature of the heat cycle. It was found that these crystallin phases, and particularly the Li metasilicate etch in weak HF at a significantly faster rate than the original glass which is still present in the unexposed regions.

In order to make accurate mechanical shapes from these materials the surface must be made optically smooth so as not to distort the rays of UV radiation as they enter the surface. Thus the surfaces must be ground and polished prior to exposure. This makes the process relatively expensive. Direct use of this technology is not practical for making display barrier ribs not only because of cost but also due to etching depth control and etch residue problems when using the bulk material in a conventional way.

An object of this invention is to provide barrier ribs which overcomes the problems involved in the prior art and significantly improves the resolution and geometrical accuracy of a flat-panel display and a technique for forming the barrier ribs. It is another object of this invention to provide a glass substrate of photosensitive material for use in directly forming the ribs of a color plasma panel display. Yet another object of the present invention is to provide a method of manufacturing a flat-panel display in which the electrodes and phosphors are self-aligned to the pattern formed by the barrier ribs. Another object of the present invention is to provide a flat-panel display having a top glass substrate, a bottom glass substrate having an etchable interior surface, and electrodes on the interior surface of each of the substrates wherein the electrodes of the bottom glass substrate are not dielectrically isolated. Another object of the present invention is to provide a flat-panel display that is simple and economical to manufacture and/or use.

SUMMARY OF THE INVENTION

Briefly, there is provided a flat-panel display comprising a hermetically sealed gas filled enclosure. The enclosure includes a top glass substrate having a plurality of electrodes and an electron emissive film covering the electrodes and a bottom glass substrate spaced from the top glass substrate. The bottom glass substrate includes a plurality of alternating barrier ribs and micro-grooves. An electrode is deposited within each micro-groove and a phosphor is deposited over a portion of each electrode.

Each micro-groove includes a base and upwardly extending surrounding sidewalls and each barrier rib includes a base, a crest and sidewalls which extend from the base to the crest. The surrounding sidewalls of adjacent micro-grooves are interconnected by the crest of an intermediate barrier rib. The electrode is deposited along the base and at least a portion of the upwardly extending surrounding sidewalls of each micro-groove.

BRIEF DESCRIPTION OF THE DRAWINGS

Further features and other objects and advantages of this invention will become clear from the following detailed description made with reference to the drawings in which:

FIG. 1 is a partial isometric view of a photosensitive glass layer atop a bottom glass plate;

FIG. 2 is a partial isometric view of the photosensitive glass layer and bottom glass plate of FIG. 1 selectively exposed to ultraviolet radiation (UV) through a mask;

FIG. 3 is a partial cross-sectional view of the photosensitive glass layer and bottom glass plate of FIG. 2 after removal of the UV exposed areas of the photosensitive glass;

DETAILED DESCRIPTION OF THE PREFERRED EMBODIMENTS

Figure 4:
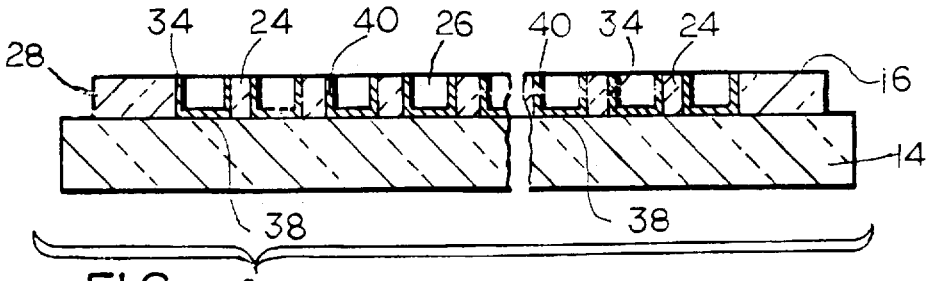
FIG. 4 is a partial cross-sectional view of the photosensitive glass layer and bottom glass plate of FIG. 3 including electrodes.
Figure 5:
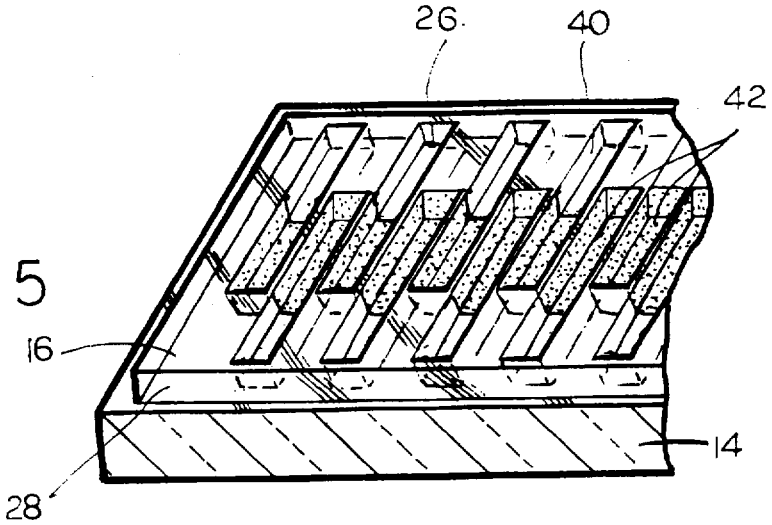
FIG. 5 is a partial isometric view of the photosensitive glass layer and bottom glass plate of FIG. 4 including a phosphorescent material applied over a portion of the electrodes.
Figure 6:
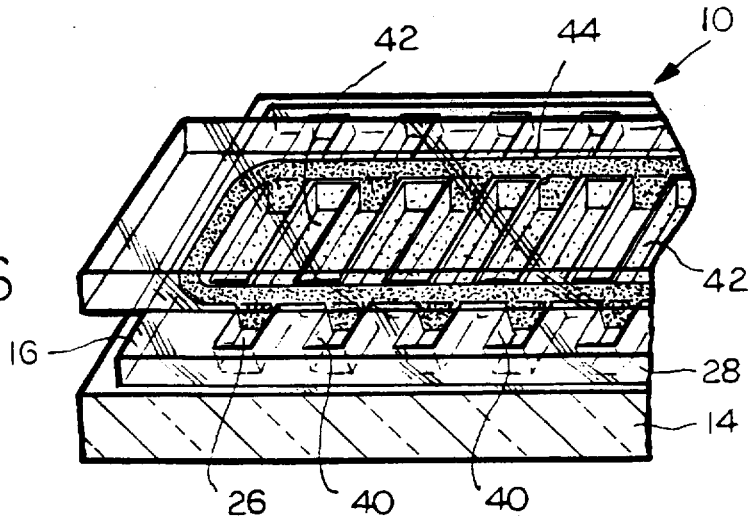
FIG. 6 is a partial isometric view of the photosensitive glass layer and bottom glass plate of FIG. 5 including a top glass plate and seal.

In the following description, like reference characters designate like or corresponding parts. Also, in the following description, it is to be understood that such terms as "top", "bottom", "forward", "rearward", and similar terms of position and direction are used in reference to the drawings and for convenience in description. In addition, for purposes of clarity and conciseness, certain proportions and details of construction may have been exaggerated or may not have been provided in view of such details being conventional and well within the skill of the art once the invention is disclosed and explained. For example, control circuits for the flat-panel display have not been illustrated in view of such circuits being well known and within the skill of the art.

Referring to the drawings, wherein like reference characters represent like elements, FIGS. 1–12 show the basic structure and steps for preparing a flat-panel display 10 in accordance with the present invention. Although, the invention is primarily described in connection with a plasma display panel, it will be readily apparent that the present invention may be used with equal facility for most any flat-panel display. Accordingly, the description of the present invention in relation to a plasma panel display is not to be construed as a limitation on the scope of the invention as claimed.

Figure 7:
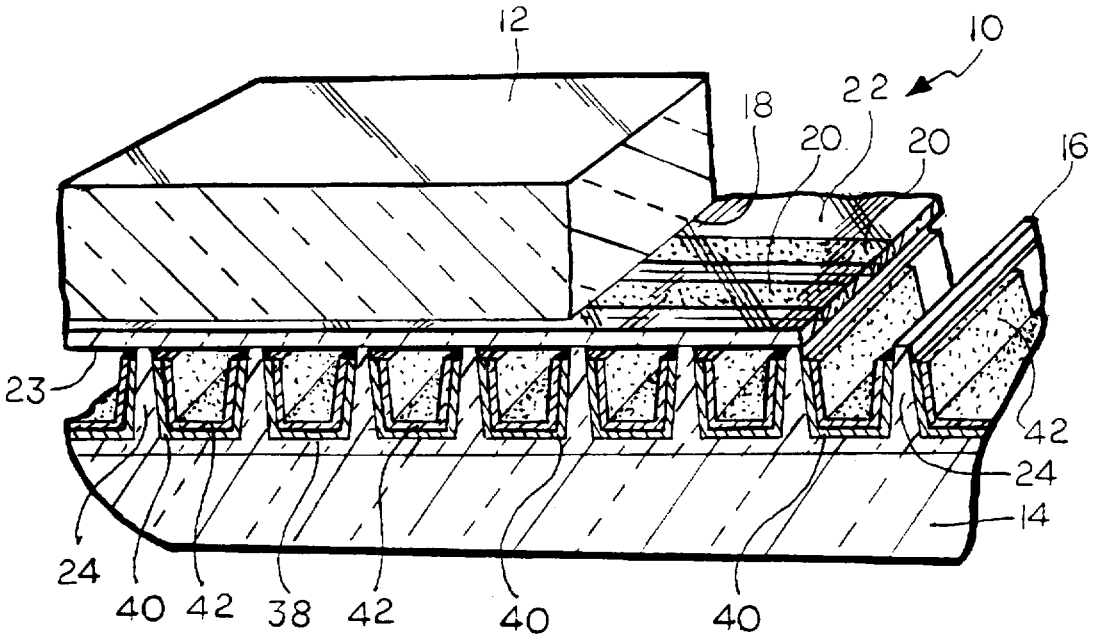
FIG. 7 is an enlarged partial isometric view of the photosensitive glass layer, bottom glass plate and top glass plate of FIG. 6.

A flat-panel display 10 for displaying an optical image in accordance with the present invention is shown in FIG. 7. The flat-panel display 10 is illustrated as a plasma display panel and includes separately manufactured components which may be operatively assembled to form the flat-panel display.

Figure 12:
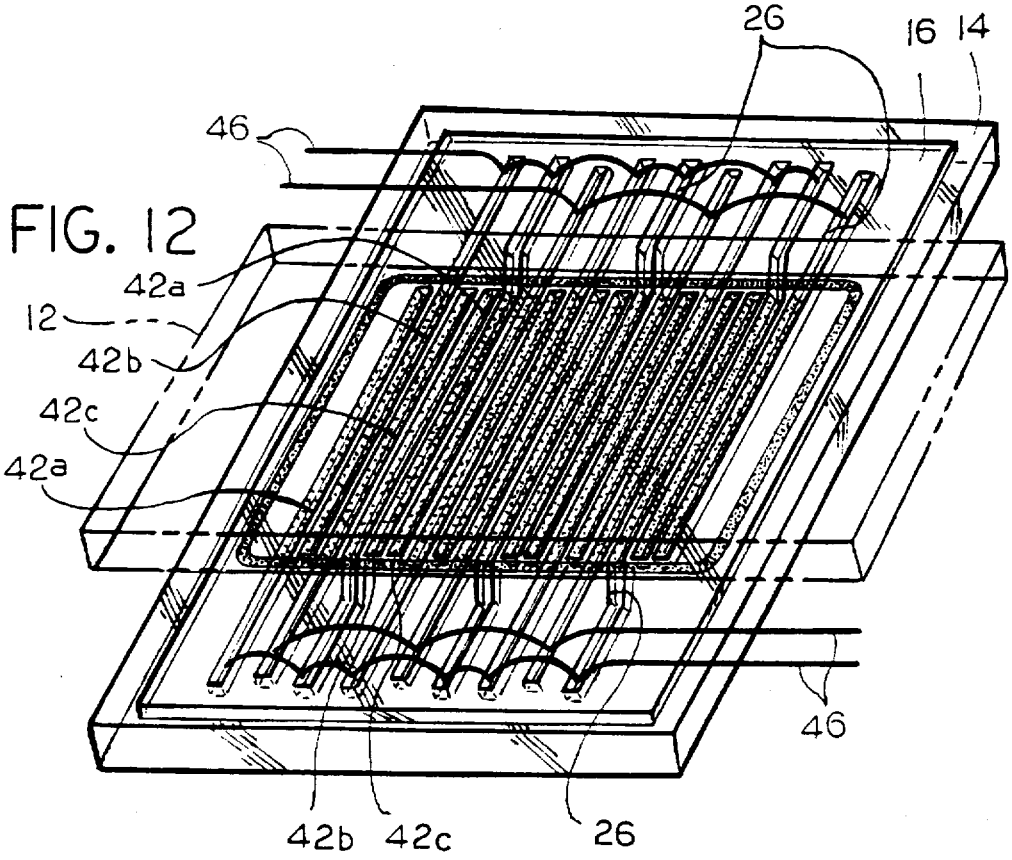
FIG. 12 is an enlarged isometric view of a plasma display panel in accordance with the present invention illustrating electrode busing interconnection of the plasma display panel; and, FIG. 13 is an enlarged partial isometric view of a photosensitive glass layer, bottom glass plate and top glass plate.
Figure 8:
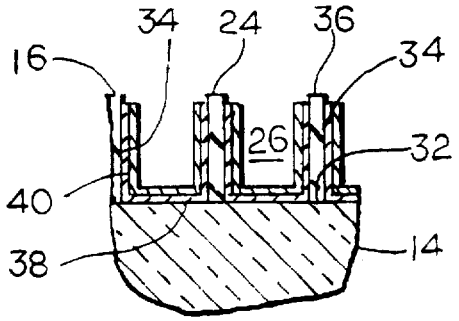
FIG. 8 is an enlarged cross-sectional view of an alternate arrangement of barrier ribs in accordance with the present invention.
Figure 9:
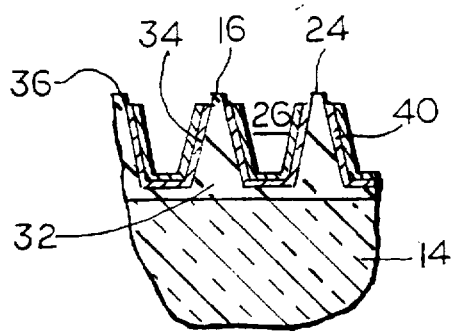
FIG. 9 is an enlarged cross-sectional view of an alternate arrangement of barrier ribs in accordance with the present invention.
Figure 10:
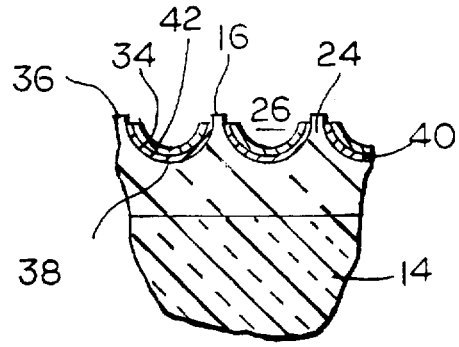
FIG. 10 is an enlarged cross-sectional view of an alternate arrangement of barrier ribs in accordance with the present invention.
Figure 11:
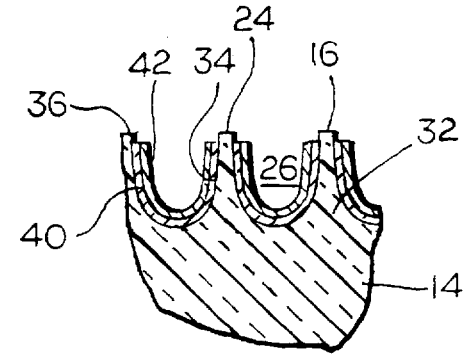
FIG. 11 is an enlarged cross-sectional view of an alternate arrangement of barrier ribs in accordance with the present invention.
Figure 13:
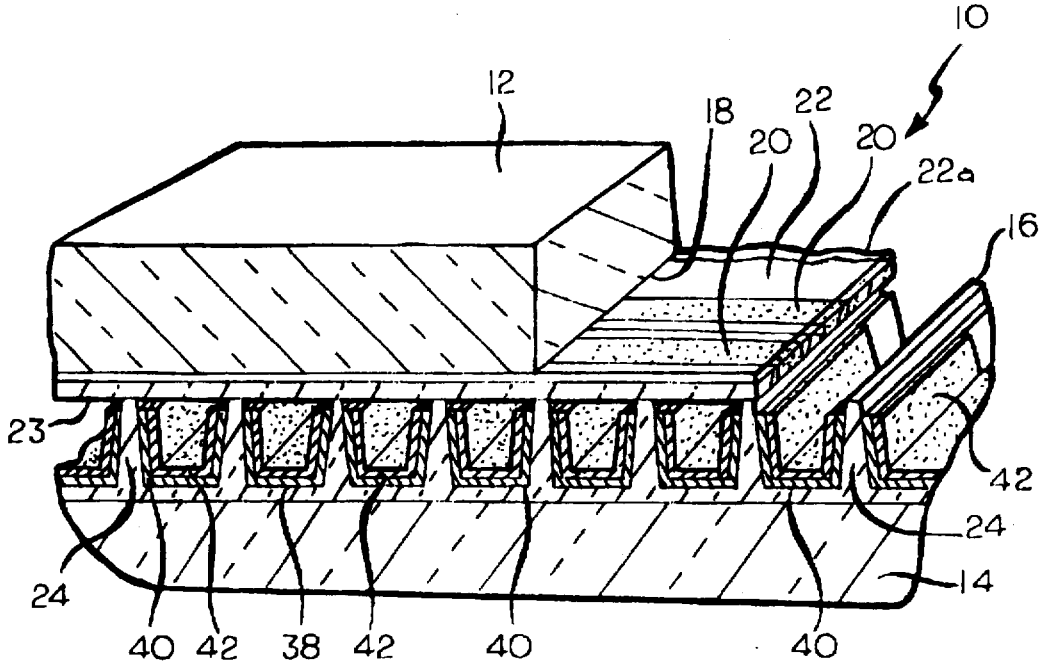

Generally, the plasma display panel comprises a hermetically sealed gas filled enclosure including a top glass substrate 12 and a spaced bottom glass substrate 14. The top glass substrate 12 is superposed the bottom glass substrate 14 as shown in FIG. 12. The glass substrates 12 and 14 are transmissive to light and of a uniform thickness, for example, the glass substrates 12 and 14 may be approximately ⅛–¼ inch thick.

The top glass substrate 12 may contain $SiO_2$, $Al_2O_3$, $MgO_2$ and CaO as the main ingredients and $Na_2O$, $K_2O$, PbO, $B_2O_3$ and the like as accessory ingredients. Deposited on the interior surface 18 of the top glass substrate 12 are a plurality of electrodes 20. The electrodes are of a type well known in the art. In a preferred embodiment, the electrodes 20 are thin film electrodes positioned generally parallel to one another and prepared from evaporated metals such as Au, Cr and Au, Cu and Au, Ta and Au, Cu and Cr, ITO and Au, Ag or Cr and the like. A uniform electron emissive film 22 such as a dielectric film or electron emitting material of a type well known in the art covers the electrodes 20 by a variety of planar techniques well known in the art of display manufacture. The dielectric film may be of most any, suitable material such as a lead glass material and the like, and the electron emitting material may be of most any suitable material such as a diamond overcoating, MgO, or the like and may be applied as a surface film (not shown). The electron emissive film 22 may be overcoated with a second thin film of MgO 22*a*.

The bottom glass substrate 14 includes a plurality of parallel barrier ribs 24 and micro-grooves 26 which extend along the interior surface 16 of the bottom glass substrate 14. The barrier ribs 24 and micro-grooves 26 may be etched in the glass forming the bottom glass substrate 14 of the panel 10 by etching the interior surface of the bottom glass substrate or the barrier ribs and micro-grooves may be formed in a separate glass layer 28 which forms a part of the bottom glass substrate by partially or totally etching the separate glass layer. The separate glass layer 28 may then be placed on the bottom glass substrate 14 to form an integral part of the bottom glass substrate either before or after etching.

Whichever process is employed, the barrier ribs 24 and micro-grooves 26 are preferably formed from an etchable glass material which is inherently selectively crystallizing, e.g., a glass-ceramic composite doped with suitable nucleating agents.

An example of a suitable glass-ceramic composite doped with a suitable nucleating agent is a photosensitive glass doped with a suitable nucleating agent. The photosensitive glass may be about 90 wt % $Li_2O$—$Al_2O_3$—$SiO_2$ and include one or more dopants selected from Ce, Ag, Au and Cu. In a preferred embodiment, the photosensitive glass includes about 73–82 wt % $SiO_2$, about 6–15 wt % $Li_2O$ and about 4–20 wt % $Al_2O_3$ and about 0.006–0.2 wt % of one or more dopants selected from Ce, Ag, Au and Cu.

The photosensitive glass may be prepared first as a photosensitive collet by heating the composition in a batch melt at 1350°–1400° C. for 3 to 4 hours in an open crucible, typically under neutralized or oxidizing conditions, but in the case of very low Ag or Cu content, under reducing conditions. In order to create oxidizing conditions, oxidizers of a type well known in the art are typically introduced into the batch melt, and if reducing conditions are required, starch or $NH_4Cl$ is added. The collet is then further broken into pieces and ground by ball milling into a powder. It will be appreciated that care must be taken to provide the correct electro-chemical environment during milling in order not to pre-sensitize the photosensitive glass and thereby lose the photosensitive property of the bottom glass substrate 14. This may be done by adding oxidizers or salts of Ag or Li to the grind.

In another embodiment, the powder may be prepared by formulating an appropriate mix of the composition of the photosensitive glass, typically as salts of nitrates, with an appropriate fuel system such as glycerine. When placed into an oven at moderate temperature, between about 500° to 600° C., this formulation will self ignite and burn rapidly, forming a foam-like product with the desired composition and characteristics which can be easily crushed into a powder.

In either embodiment, the resultant powder can be mixed with a vehicle and applied uniformly to the bottom glass substrate 14 to form the interior surface 16 by, for example, screen printing on to the bottom glass substrate. The bottom glass substrate 14 is then fired between 590° to 620° C. for a period of approximately one hour to sinter the powder into a uniform glassy photosensitive surface layer. It will be appreciated that the powder must be protected against unintentional UV radiation through sintering to preserve the photosensitive property of the bottom glass substrate 14.

When the photosensitive glass has sufficiently cooled, the bottom glass substrate 14 is then exposed to UV radiation in the range of about 250 to 340 nm through a mask 30, typically of quartz. The mask allows UV radiation to pass to the photosensitive glass in a particular desired pattern corresponding to the pattern of the micro-grooves 26 to be formed.

In an alternate embodiment, the mask 30 may be patterned by laminating directly onto the photosensitive glass a standard negative photo-resist of a type well known in the art, sometimes with a metal composition thin-film layer which is first applied as a masking material and then selectively etched to form the mask directly upon the surface which can later be used for other purposes.

The UV radiation breaks the Ag, Au or Cu bonds within the photosensitive glass to form individual atoms of Ag, Au or Cu. The Ag, Au or Cu atoms form a latent pattern in the photosensitive glass corresponding to the mask 30 pattern.

Once exposed to the UV radiation, the photosensitive glass is again heated to about 520° C. such that the Ag, Au or Cu atoms agglomerate. The photosensitive glass 28 is then heated to around 600° C. such that crystals of the photosensitive glass, e.g., Li metasilicate, Li disilicate, Eucryptite and Spodumene phases of the photosensitive glass form around the Ag, Au or Cu agglomerates acting as nucleating agents and form etchable crystals in the areas of the mask 30 pattern which are exposed. The type and size of crystallin phases formed in the photosensitive glass 28 is determined as a function of the time and temperature of the heat.

In an alternate embodiment, a pre-sensitized material, such as a crystalline glass containing nucleating agents, and unsensitized material, such as a crystalline glass not containing nucleating agents, may be first prepared. The sensitized material may be arranged into micro-grooves into a pattern in a thick photoresist layer conventionally prepared.

Alternatively, the powder may be electrophyretically deposited in order to more easily enter and fill the micro-grooves. The photo-resist is then removed and the second type unsensitized glass powder is then filled in the voids formed by the photoresist removal. The composition is then fired as previously described for growing crystals.

As a result, the bottom glass substrate 14 has a desired sensitized pattern formed within the first 20 to 200 micrometers of the interior surface of the bottom glass substrate. The present invention takes advantage of the differential etching rates for the ceramic and the glassy material of the photosensitive glass 28. The ceramic phase results from UV exposure and subsequent heat treatment of the entire substrate. The ceramic phase etches at rates up to 30 times faster than the glassy phase. The difference in the etch rates allows for high aspect ratio barrier ribs to be formed in the bottom glass substrate 14.

The bottom glass substrate 14 is then etched in a weak HF acid solution of about 5 to 10% for approximately 4–10 minutes, or until substantially all of the crystallized material has been removed to the desired depth to form the micro-grooves 26 and the barrier ribs 24. The micro-grooves 26 may be about 50–150 μm deep, preferably about 120 μm deep, and about 50–200 μm wide, preferably at least about 100 μm wide. When the micro-grooves 26 and barrier ribs 24 are formed in a separate glass layer 28 by etching the glass layer, it is preferred that the depth of the micro-grooves are equal to the entire thickness of the glass layer to overcome problems presented in the use of materials having different expansion properties.

As shown in FIGS. 8–11, the barrier ribs 24 and micro-grooves 26 may be of most any suitable size and shape by varying the size and/or shape of the openings within the mask 30. Each barrier rib 24 includes a base 32 and sidewalls 34 which extend vertically from the base to a crest 36. In a preferred embodiment, the barrier ribs 24 have a uniform base 32 width and height and a high aspect ratio of more than 3:1, preferably more than 5:1, and most preferably more than 7:1. Defined between the barrier ribs 24 are the longitudinally extending micro-grooves 26 having a base 38 and sidewalls 34 corresponding to the sidewalls of adjacent barrier ribs.

Deposited along the base 38 and surrounding sidewalls 34 of each micro-groove 26 is an electrode 40. The electrode 40 is deposited along the base 38 and surrounding sidewalls 34 to increase uniformity of firing and provide optimum phosphor coating along the entire surface of the micro-groove 26. The electrode 40 is deposited by selectively metalizing a thin layer of Cr and Au or Cu and Au or Ta and Au, or ITO and Au, or Cu and Cr, or Ag or Cr within the micro-groove surface 34 and 38. The metallization may be accomplished by thin film deposition, E-beam deposition or electroless deposition and the like as well known in the art. In a preferred embodiment, about 300–1000 Å units of Cr followed by about 1000–20,000 Å units Au may be deposited by E-beam deposition or 1–2 μm of Cu followed by a thin layer of Au may be deposited by electroless deposition.

The electrode metal may be removed from the crest 36 of each barrier rib 24 by polishing, filling the micro-grooves 26 with a suitable polymer and etching or a variety of other techniques known in the art using the crest as the differentiating parameter.

Deposited over a portion of the electrode 40 of each micro-groove 26 is a phosphor material 42. In a preferred embodiment, the phosphor material 42 is deposited by electrophoresis as well known in the art. The phosphor material 42 is of a standard electron excited phosphor material of a type well known in the art. For a full color display, multi-color phosphors such as red **42*a*, green 42*b* and blue 42*c* phosphors are oriented in groups of three and applied in bands or dots at the appropriate pixel locations. The phosphor material 42** deposition may be accomplished by repetitive timed pulses, ranging from about 50–500 milliseconds with about 3–30 second idle periods there between to promote uniformity in the thickness and coverage of the resultant phosphor material. The phosphor deposition bath may contain an additive material in suspension to promote adhesion of the deposited phosphor. Suitable additives include powdered wax, alone or in combination with dissolved salts, acids or solvent materials or their derivatives.

The electrode deposited within each micro-groove 26 forms a plurality of electrodes arranged in a repeating array of a first color electrode, a second color electrode and a third color electrode. The first color electrode of each array extends beyond the top glass substrate to a first end of the bottom glass substrate, the second color electrode of each array extends beyond the top glass substrate to a second end of the bottom glass substrate opposite of the first end, and the third color electrode of each array alternately extends beyond the top glass substrate to the first end of the bottom glass substrate and to the second end of the bottom glass substrate. For a full-color display, the color electrodes may be formed by red **42*a*, green 42*b* and blue 42*c* phosphors separately deposited in an alternating repetitive pattern at the appropriate pixel locations as shown in the figures. The phosphor colors are deposited to produce an alternating striped pattern in-adjacent micro-grooves 26. The resolution of the flat-panel display 10** is determined by the number of pixels per unit area.

In an alternate embodiment, the phosphor material 42 deposition may be performed by connections to four bussed electrode groups arranged two per end 46, one for each of colors **42*a* and 42*b* and two for color 42*c*** in order to minimize the pitch on the two opposing external connection end areas and thus minimize the number of crossover bus connections required during manufacture.

The phosphor material 42 and electrodes 40 on the micro-grooves 26 may be overcoated with a thin film layer to reduce sputtering or UV damage or minimize differences in secondary emissions characteristic, between phosphor material. The thin film layer may be a thin film of MgF and the like as well known in the art.

A vacuum is established between the glass substrates 12 and 14 and hermetically sealed with a conventional glass seal 44 such as a metallic seal of indium or the like and filled with an ionizable gas. The space or gap between the glass substrates 12 and micro-grooves 26 in glass substarte 14 is approximately 25–100 microns. In a preferred embodiment, the ionizable gas is a proportioned mixture of two or more gases that produce sufficient UV radiation to excite the phosphor material 42. For example, a suitable ionizable gas mixture includes neon and from about 5–20 wt % xenon and helium.

The pixel sustaining and addressing functions of the panel 10 are accomplished by selective timing of pulsed electrical potentials causing stable sequences of discharges between the opposed substrates 12 and 14 at or in the vicinity of the cross-points. The pulsed electrode potentials may be between paired electrode groups on the top glass substrate 12 and electrodes in the bottom glass substrate 14. More particularly, neighboring pairs of electrodes 20 are extended to a opposing ends of the top glass substrate 12 and externally connected to an appropriate driving circuitry and power supply as known in the art. Similarly, electrodes 40 of the opposing bottom glass substrate 14 containing the barrier ribs 24 are externally connected individually to an appropriate driving circuitry and power supply as known in the art.

The following are detailed examples of the fabrication of barrier ribs 24 and micro-grooves 26 in accordance with the present invention and a flat-panel display 10 in accordance with the present invention. It will be understood that the examples are not intended to limit the scope of the invention.

EXAMPLE 1

Barrier ribs 24 and micro-grooves 26 were formed in a polished piece of Fotoceram doped with Ag and approximately 1 mil thick and 6 inches square. The barrier ribs and micro-grooves were formed by exposing the Fotoceram to UV radiation through a Cr, Au mask on quartz for about 6 minutes at a distance of about 4 feet. The UV radiation was supplied from a modified commercially available Olite bulb typically used for exposure in the printing industry. The Olite bulb was modified by removing the safety glass and replacing the safety glass with the quartz mask. The Olite bulb produced a wavelength of about 320 nm to penetrate the Fotoceram.

The UV treated Fotoceram was then placed in an oven and ramp heated at a rate of about 5° C./minute to a temperature of about 590° C. and then maintained at this temperature for about 1 hour and then cooled at a rate of about 6° C./minute. After cooling, the Fotoceram was etched in a tray containing 10% HF solution for about 6 minutes to form micro-grooves about 100 μm wide and 0.00045 of an inch deep and barrier ribs. The Fotoceram was then sandblasted with a soft lead glass powder to remove any debris which remained in the bottom of each of the micro-grooves.

EXAMPLE 2

The Fotoceram substrate containing micro-grooves and barrier ribs of Example 1 was then metallized with approximately 1500 Å Cr followed by approximately 12000 Å Au in a E-beam system box coater 40 inches in diameter of a type well known in the art. Thereafter, the substrate was coated with a photoresist, Shipley Microposit Positive Resist, approximately 3 times by a spray method. On the last coating application, the substrate was heated to about 190° F. The substrate was then soft baked for about 30 minutes and exposed for about 2 minutes under the aforementioned Olite system but with the safety glass in place so that shortest wavelength the substrate was exposed to was about 340–360 nm. The substrate was then developed in a slightly caustic solution for about 30 seconds, etched in a tray containing a standard potassium iodine solution for Au etch followed by a standard solution for Cr etch. The solution removed the conductor material on the top surface of the barrier ribs which was exposed by photoresist exposure. The material in the micro-grooves was not exposed because the photoresist was sufficiently thick such that light-exposure did not destroy the polymer cross-linking in a given development time.

The substrate was then placed in a tank containing about 2 liter of isopropyl alcohol and 5 grams of a chosen phosphor having a particle size of about 2–10 μm, stirred with a molar concentration of $5\times10^{-3}$ moles of magnesium nitrate, voltage of about −100 volts was then applied to chosen electrodes for phosphor deposition and 0 volts to both anodes and micro-grooves which were not to have the chosen phosphor applied. The phosphor deposition time was about 2 minutes. After 3 different color phosphors were applied by the above method, the substrate was heated to about 410° C. for about 1 hour to convert all of the hydroxides to the oxide form so as not to contaminate the finished product. The substrate was then mated with a front plate having a paired artwork pattern by way of industry standard seal material, such as a lead glass, and then fired at 410° C. for about 1 hour to accomplish a seal.

The flat-display panel was then evacuated to a vacuum of $10^{-7}$ torr and heated in a 10 hour cycle to 385° C. After cool down, a mix of about 5 wt % xenon gas and 95 wt % neon gas was introduced at a pressure of 500 torr to the panel to produce a plasma flat panel display in accordance with the present invention.

It will be appreciated that although the invention was primarily developed in connection with large high resolution color flat panel displays finding application as a video display, in computer assisted design displays, displays for air traffic controllers, multiple page displays for programmers and the like, it will be readily apparent that the flat panel display may find application in most any instance where a large panel display may be required or is beneficial.

The documents, patents and patent applications referred to herein are hereby incorporated by reference.

Having described presently preferred embodiments of the invention, it is to be understood that it may be otherwise embodied within the scope of the appended claims.

What is claimed is:

1. A flat-panel display comprising a hermetically sealed gas filled enclosure, said enclosure including a top glass substrate having a plurality of top glass substrate electrodes and an electron emissive film covering said top glass substrate electrodes;

a bottom glass substrate spaced from said top glass substrate, said bottom glass substrate having a plurality of alternating barrier ribs and micro-grooves; each said barrier rib including a base, a crest and sidewalls which extend from said base to said crest;

a bottom glass substrate electrode formed of metal and deposited within each said micro-groove and extending up to at least a substantial portion of said sidewalls; and a phosphor material deposited on and coincident with each said bottom glass substrate electrode.

2. The flat-panel display of claim 1 wherein each said micro-groove includes a base and upwardly extending surrounding sidewalls; said surrounding sidewalls of adjacent micro-grooves being interconnected by said crest of an intermediate barrier rib.

3. The flat-panel display of claim 2 wherein said bottom glass substrate includes an interior surface of an etchable glass material which is selectively crystallizing.

4. The flat-panel display of claim 3 wherein said etchable glass material is a glass-ceramic composite doped with at least one nucleating agent.

5. The flat-panel display of claim 4 wherein said glass-ceramic composite is a photosensitive glass.

6. The flat-panel display of claim 3 wherein said etchable glass material includes about 90 wt % $Li_2O$—$Al_2O_3$—$SiO_2$ and at least one dopant selected from the group consisting of Ce, Ag, Au and Cu.

7. The flat-panel display of claim 3 wherein said etchable glass material includes about 73–82 wt % $SiO_2$, about 6–15 wt % $Li_2O$, about 4–20 wt % $Al_2O_3$ and about 0.006–0.2 wt % of at least one dopant selected from the group consisting of Ce, Ag, Au and Cu.

8. The flat-panel display of claim 2 wherein said electron emissive film is an electron emitting material.

9. The flat-panle display of claim 2 wherein said electron emissive film is a dielectric film.

10. The flat-panel display of claim 9 wherein said dielectric film is overcoated with a thin film of MgO.

11. The flat-panel display of claim 2 wherein each said bottom glass substrate electrode is deposited by selectively metalizing one or more layers selected from Cr and Au; Cu and Au; Ta and Au; Ag, Cr; Cu and Cr; or ITO and Au.

12. The flat-panel display of claim 2 wherein red, green and blue phosphors are deposited in separate adjacent micro-grooves.

13. The flat-panel display of claim 2 wherein said barrier ribs have an aspect ratio of more than 3:1.

14. The flat-panel display of claim 2 wherein said barrier ribs have an aspect ratio of more than 5:1.

15. The flat-panel display of claim 2 wherein said micro-grooves are about 50–150 μm deep and about 50–200 μm wide.

16. The flat-panel display of claim 2 wherein said micro-grooves are about 120 μm deep and at least about 100 μm wide.

17. The flat-panel display of claim 2 wherein said barrier ribs are about 100 μm high and less than 20 in width and spaced at about 120 pitch.

18. The flat-panel display of claim 1 wherein said top glass substrate electrodes of said top glass substrate are thin film electrodes.

19. The flat-panel display of claim 18 wherein said thin film electrodes are prepared from evaporated Cr and Au; Cu and Au; Ta and Au; Ag, Cr, Cu and Cr; or ITO and Au.

20. The flat-panel display of claim 1 wherein said bottom glass substrate electrode deposited over each said micro-groove forms a plurality of electrodes arranged within said bottom glass substrate in a repeating array comprising a first electrode, a second electrode and a third electrode;

said first electrode having a connection end extending beyond said top glass substrate to a first exposed end of said bottom glass substrate;

said second electrode of each array having a connection end extending beyond said top glass substrate to a second exposed end of said bottom glass substrate opposite of said first exposed end; and said third electrode of each array having a connection end extending beyond said top glass substrate to one of said first and second exposed ends, said third electrode connection end of each alternating array of electrodes alternating between the first exposed end and the second exposed end of said bottom glass substrate.

21. A flat-panel display comprising a hermetically sealed gas filled enclosure, said enclosure including a top glass substrate having a plurality of top substrate electrodes and a thin dielectric film covering said top substrate electrodes;

a bottom glass substrate spaced from said top glass substrate, said bottom glass substrate having an interior surface of an etchable glass material which is selectively crystallizing and having a plurality of alternating barrier ribs and micro-grooves; each said micro-groove including a micro-groove base and upwardly extending surrounding sidewalls and each said barrier rib having an aspect ratio of more than 3:1 and including a barrier rib base, a crest and sidewalls which extend from said barrier rib base to said crest; said surrounding sidewalls of adjacent micro-grooves being interconnected by said crest of an intermediate barrier rib;

a bottom glass substrate electrode formed of metal and extending up to at least a substantial portion of said sidewalls; and red, green and blue phosphors deposited in separate adjacent micro-grooves on each said bottom glass substrate electrode.

22. The flat-panel display of claim 21 wherein said barrier ribs have an aspect ratio of more than 5:1.

23. The flat-panel display of claim 21 wherein said micro-grooves are about 50–150 μm deep and about 50–200 μm wide.

24. The flat-panel display of claim 21 wherein said bottom glass substrate includes an interior surface of an etchable glass material which is selectively crystallizing and wherein said etchable glass material is a glass-ceramic composite doped with at least one nucleating agent.

25. The flat-panel display of claim 24 wherein said glass-ceramic composite is a photosensitive glass.

* * * * *